US005950981A

United States Patent [19]

Judy

[11] Patent Number: 5,950,981

[45] Date of Patent: Sep. 14, 1999

[54] BEAR BAG SYSTEM

[76] Inventor: Kenith M. Judy, 7411 Langley Cyn Rd., Salinas, Calif. 93907

[21] Appl. No.: 08/933,424

[22] Filed: Sep. 18, 1997

[51] Int. Cl.[6] ..... B65B 67/04

[52] U.S. Cl. ..... 248/693; 248/100; 383/23

[58] Field of Search ..... 248/693, 317, 248/99, 100, 101, 339; 383/23, 33; 24/115 H, 129 R, 129 A, 599.8

[56] References Cited

U.S. PATENT DOCUMENTS 5,344,109 9/1994 Hokoana, Jr. ..... 248/100

*Primary Examiner*—Leslie A. Braun

*Assistant Examiner*—Long Dinh Phan

[57] ABSTRACT

A new BEAR BAG SYSTEM for PROTECTING A SUPPLY OF FOOD WHILE CAMPING. The inventive device includes a length of nylon rope having opposing free ends. A bag of rocks is securable to one of the free ends of the length of nylon rope. Two supplemental bags are provided for storing food. Two lengths of curtain cord adjustably couple the supplemental bags with respect to the length of nylon cord.

4 Claims, 2 Drawing Sheets

BEAR BAG SYSTEM

BACKGROUND OF THE INVENTION

1. Field of the Invention

The present invention relates to SUSPENSION SYSTEMS and more particularly pertains to a new BEAR BAG SYSTEM for PROTECTING A SUPPLY OF FOOD WHILE CAMPING.

2. Description of the Prior Art

The use of SUSPENSION SYSTEMS is known in the prior art. More specifically, SUSPENSION SYSTEMS heretofore devised and utilized are known to consist basically of familiar, expected and obvious structural configurations, notwithstanding the myriad of designs encompassed by the crowded prior art which have been developed for the fulfillment of countless objectives and requirements.

Known prior art SUSPENSION SYSTEMS include U.S. Pat. No. 5,344,109 to Hokoana, Jr.; U.S. Pat. No. 5,117,942 to Tzavaras; U.S. Pat. No. Des. 285,217 to Smernoff; U.S. Pat. No. 5,337,915 to Hall, Jr.; U.S. Pat. No. 5,354,131 to Mogil; and U.S. Pat. No. 5,279,062 to Burgeson.

While these devices fulfill their respective, particular objectives and requirements, the aforementioned patents do not disclose a new BEAR BAG SYSTEM. The inventive device includes a length of nylon rope having opposing free ends. A bag of rocks is securable to one of the free ends of the length of nylon rope. Two supplemental bags are provided for storing food. Two lengths of curtain cord adjustably couple the supplemental bags with respect to the length of nylon cord.

In these respects, the BEAR BAG SYSTEM according to the present invention substantially departs from the conventional concepts and designs of the prior art, and in so doing provides an apparatus primarily developed for the protection of a supply of food while camping.

SUMMARY OF THE INVENTION

In view of the foregoing disadvantages inherent in the known types of SUSPENSION SYSTEMS now present in the prior art, the present invention provides a new BEAR BAG SYSTEM construction wherein the same can be utilized for PROTECTING A SUPPLY OF FOOD WHILE CAMPING.

The general protecting of a supply of food while camping of the present invention, which will be described subsequently in greater detail, is to provide a new BEAR BAG SYSTEM apparatus and method which has many of the advantages of the SUSPENSION SYSTEMS mentioned heretofore and many novel features that result in a new BEAR BAG SYSTEM which is not anticipated, rendered obvious, suggested, or even implied by any of the prior art SUSPENSION SYSTEMS, either alone or in any combination thereof.

To attain this, the present invention generally comprises a length of nylon rope having opposing free ends. The rope has a length of at least fifty feet. A bag of rocks is securable to one of the free ends of the length of nylon rope. Two supplemental bags are provided for storing food. Two lengths of curtain cord are provided. Each of the lengths of cord have a length of at least twenty-four inches. One end of each curtain cord have a hook secured thereto. An opposing end of each curtain cord are coupled with the supplemental bags. The opposing end of each curtain cord are coupled with the supplemental bags with a slip knot grip rod. Two S-8 rings are provided with each having a small upper circle and a large lower circle. Each small upper circle is coupled with the length of nylon rope. Each large lower circle is coupled with the hooks disposed on the ends of the curtain cords.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the protecting of a supply of food while camping of description and should not be regarded as limiting.

As such, those skilled in the art will appreciate that the conception, upon which this disclosure is based, may readily be utilized as a basis for the designing of other structures, methods and systems for carrying out protecting a supply of food while camping of the present invention. It is important, therefore, that the claims be regarded as including such equivalent constructions insofar as they do not depart from the spirit and scope of the present invention.

Further, the protecting of a supply of food while camping of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new BEAR BAG SYSTEM apparatus and method which has many of the advantages of the SUSPENSION SYSTEMS mentioned heretofore and many novel features that result in a new BEAR BAG SYSTEM which is not anticipated, rendered obvious, suggested, or even implied by any of the prior art SUSPENSION SYSTEMS, either alone or in any combination thereof.

It is another object of the present invention to provide a new BEAR BAG SYSTEM which may be easily and efficiently manufactured and marketed.

It is a further object of the present invention to provide a new BEAR BAG SYSTEM which is of a durable and reliable construction.

An even further object of the present invention is to provide a new BEAR BAG SYSTEM which is susceptible of a low cost of manufacture with regard to both materials and labor, and which accordingly is then susceptible of low prices of sale to the consuming public, thereby making such BEAR BAG SYSTEM economically available to the buying public.

Still yet another object of the present invention is to provide a new BEAR BAG SYSTEM which provides in the apparatuses and methods of the prior art some of the advantages thereof, while simultaneously overcoming some of the disadvantages normally associated therewith.

Still another object of the present invention is to provide a new BEAR BAG SYSTEM for PROTECTING A SUPPLY OF FOOD WHILE CAMPING.

Yet another object of the present invention is to provide a new BEAR BAG SYSTEM which includes a length of nylon rope having opposing free ends. A bag of rocks is securable to one of the free ends of the length of nylon rope. Two supplemental bags are provided for storing food. Two lengths of curtain cord adjustably couple the supplemental bags with respect to the length of nylon cord.

Still yet another object of the present invention is to provide a new BEAR BAG SYSTEM that is employed with the use of a tree branch for elevating bags of food above a ground area.

Even still another object of the present invention is to provide a new BEAR BAG SYSTEM that only allows human beings access to food storage units by protecting them from wild animals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
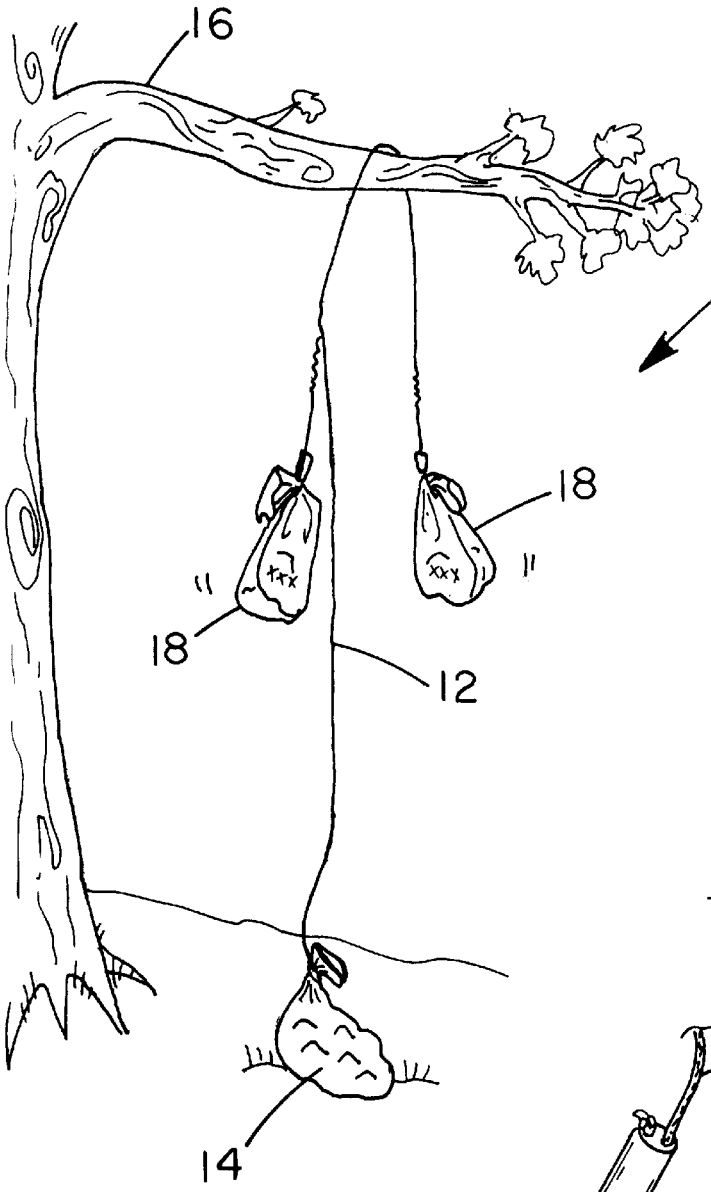
FIG. 1 is an in use view of a new BEAR BAG SYSTEM according to the present invention.
Figure 2:
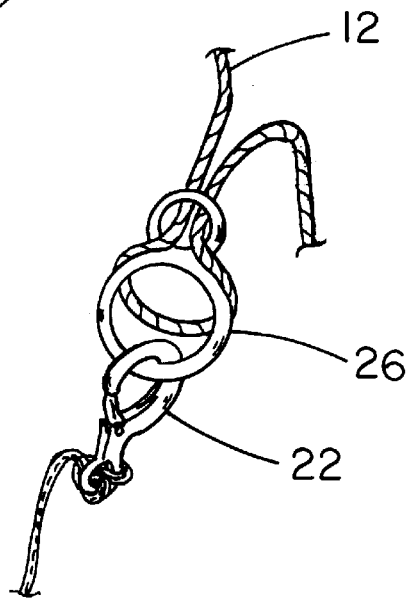
FIG. 2 is a fragmentary view of the S-8 ring of the present invention.
Figure 3:
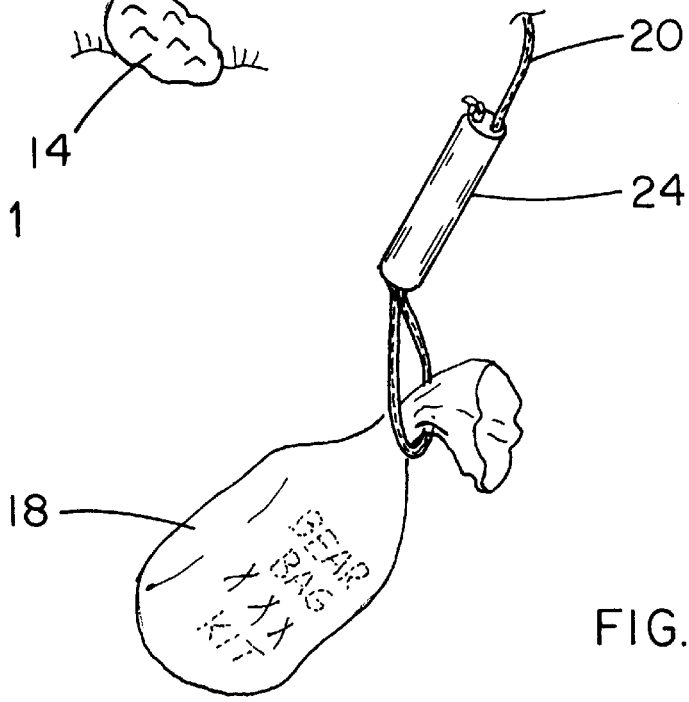
FIG. 3 is a fragmentary view of the food bag as coupled with the cord of the present invention.
Figure 4B:
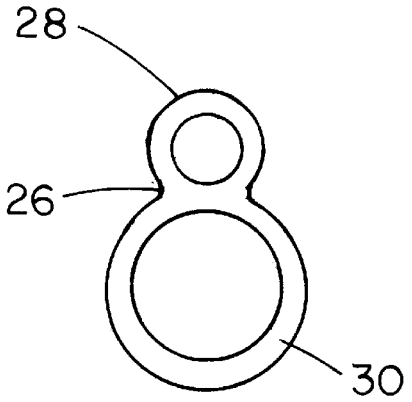
FIG. 4*b* is a plan view of the S-8 ring of the present invention.
Figure 4A:
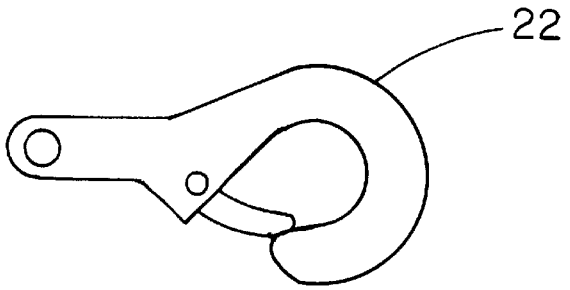
FIG. 4*a* is a side view of the hook of the present invention.
Figure 4C:
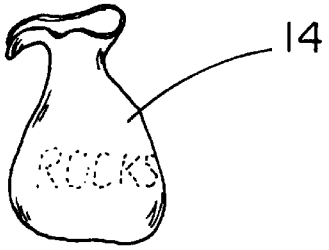
FIG. 4*c* is a side view of the bag of rocks of the present invention.
Figure 4D:
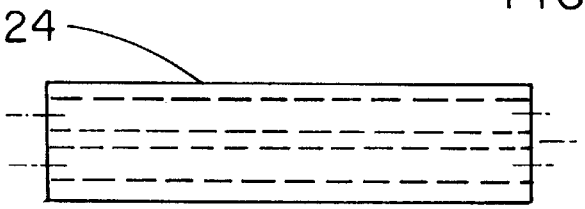
FIG. 4*d* is a side view of the slip knot grip rod of the present invention.
Figure 4E:
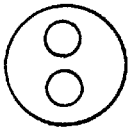
FIG. 4*e* is an end view of the slip knot grip rod of the present invention.
Figure 4F:
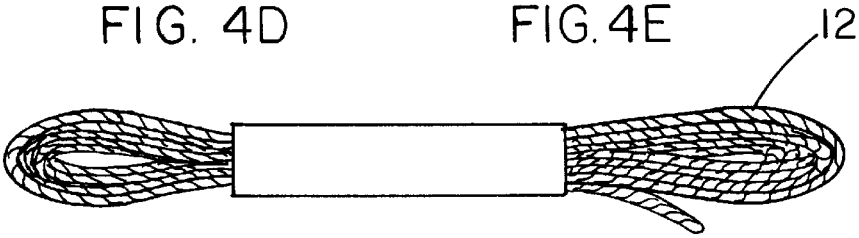
FIG. 4*f* is a side view of the length of cord of the present invention.
Figure 4G:
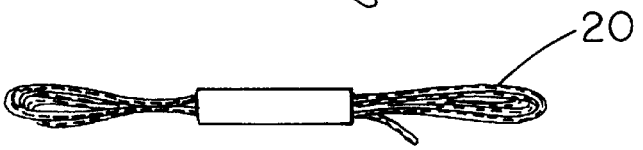
FIG. 4*g* is a side view of the curtain cord of the present invention.
Figure 4H:
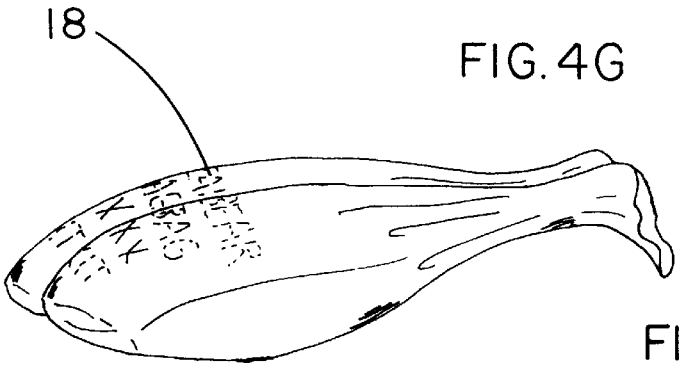
FIG. 4*h* is a side view of the food bags of the present invention.

With reference now to the drawings, and in particular to FIGS. 1 through 4*g* thereof, a new BEAR BAG SYSTEM embodying the principles and concepts of the present invention and generally designated by the reference numeral 10 will be described.

As best illustrated in FIGS. 1 through 4*g*, the BEAR BAG SYSTEM 10 comprises a length of nylon rope 12 having opposing free ends. The rope 12 has a length of at least fifty feet. The length of rope 12 needs to be long enough to elevate at least ten feet above a ground surface. In some areas, the food will need to be elevated even higher above the ground surface.

A bag of rocks 14 is securable to one of the free ends of the length of nylon rope 12. Alternately, a single rock could be used. However, the bag of rocks 14 is preferable because of the ease of securing the bag to the length of nylon rope 12. Once the bag of rocks 14 is secured to the rope 12, the rocks are then thrown over a selected tree limb 16 to provide a balance for the employment of the remainder of the system.

Two supplemental bags 18 are provided for storing food. The bags 18 are used to store selected amounts of food determined to be needed on a camping or hunting venture. One of the supplemental bags 18 could also be used to store the components of the system.

Two lengths of curtain cord 20 are provided. Each of the lengths of cord 20 have a length of at least twenty-four inches. One end of each curtain cord 20 has a hook 22 secured thereto. An opposing end of each curtain cord 20 are coupled with the supplemental bags 18. The opposing end of each curtain cord 20 are coupled with the supplemental bags 18 with a slip knot grip rod 24.

Two S-8 rings 26 are provided with each having a small upper circle 28 and a large lower circle 30. Each small upper circle 28 is coupled with the length of nylon rope 12. The length of nylon rope 12 is wrapped around the small upper circle 28 with joined ends of the rope then threaded through the small upper circle 28 to create a pulley. Each large lower circle 30 is coupled with the hooks 22 disposed on the ends of the curtain cords 20.

In use, the length of rope 12 is tied to the bag of rocks 14. The bag of rocks is then carefully thrown over a selected tree limb 16. The curtain cords 20 are then secured to the supplemental food bags 18 via the slip knot grip rods 24. The hooks 22 on the curtain cords 20 are then secured to the S-8 rings 26. The nylon rope 12 is then wrapped around the small upper circle 28 with the free ends of the rope 12 then fed through the small upper circle 28 to create a pulley effect whereby the supplemental bags 18 can be raised upwardly along the length of rope 12 to the desired elevated position. The supplemental bags 18 are balanced on opposing sides of the tree limb 16 to prevent the bags 18 from accidentally falling.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A food storage and suspension system for protecting a supply of food from wild animals while camping comprising, in combination:

a length of nylon rope having opposing free ends, the rope having a length of at least fifty feet;

a bag of rocks securable to one of the free ends of the length of nylon rope;

two supplemental bags for storing food;

two lengths of curtain cord, each of the lengths of cord having a length of at least twenty-four inches, one end of each curtain cord having a hook secured thereto, an opposing end of each curtain cord coupled with the supplemental bags by a slip knot grip rod;

two S-8 rings each having a small upper circle and a large lower circle, each small upper circle coupled with the length of nylon rope, each large lower circle coupled with the hooks disposed on the ends of the curtain cords.

2. A food storage and suspension system for protecting a supply of food from wild animals while camping, said system comprising:

a length of rope having opposing free ends, the rope having a length of at least fifty feet;

a bag of rocks securable to one of the free ends of the length of rope;

two supplemental bags for storing food;

two lengths of cord adjustably coupling the supplemental bags with respect to the length of rope, each of the lengths of cord having a length of at least twenty-four inches, one end of each cord having a hook secured thereto, an opposing end of each cord coupled with the supplemental bags by a slip knot grip rod; and two rings each having an upper circle and a lower circle, each upper circle coupled with the length of rope, each lower circle coupled with the hooks disposed on the ends of the cords.

3. The food storage and suspension system as set forth in claim 2 wherein each of said rings comprises an S-8 ring with each ring having a relatively smaller upper circle and a relatively larger lower circle.

4. A method of storing and suspending food comprising, in combination:

providing a length of nylon rope having opposing free ends, the rope having a length of at least fifty feet;

providing a bag of rocks securable to one of the free ends of the length of nylon rope;

throwing the bag of rocks over a tree limb so that the length of nylon rope is extended over the tree limb;

providing two supplemental bags for storing food;

placing a predetermined amount of food within the supplemental bags;

providing two lengths of curtain cord, each of the lengths of cord having a length of at least twenty-four inches, one end of each curtain cord having a hook secured thereto, an opposing end of each curtain cord coupled with the supplemental bags by a slip knot grip rod;

providing two S-8 rings each having a small upper circle and a large lower circle, each small upper circle coupled with the length of nylon rope, each large lower circle coupled with the hooks disposed on the ends of the curtain cords whereby the two supplemental bags can be raised on opposing sides of the tree limb in a balanced orientation.

* * * * *